US006394058B2

(12) United States Patent
Fegg

(10) Patent No.: US 6,394,058 B2
(45) Date of Patent: May 28, 2002

(54) CRANK CASE HAVING AN OIL SEPARATION WALL

(75) Inventor: Stefan Fegg, Korntal-Muenchingen (DE)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/745,318

(22) Filed: Dec. 21, 2000

(30) Foreign Application Priority Data

Dec. 23, 1999 (DE) ..... 199 62 483
Apr. 20, 2000 (DE) ..... 100 19 560

(51) Int. Cl.[7] ..... F02F 7/00

(52) U.S. Cl. ..... 123/195 C; 123/196 R; 184/6.5

(58) Field of Search ..... 123/195 C, 196 R, 123/195 R; 184/6.2, 106, 6.5

(56) References Cited

U.S. PATENT DOCUMENTS

| | | | | |
|---|---|---|---|---|
| 4,773,366 A | | 9/1988 | Seidl et al. | |
| 5,247,915 A | | 9/1993 | Sasada et al. | |
| 5,452,692 A | | 9/1995 | Spray et al. | |
| 5,711,614 A | | 1/1998 | Wuest et al. | |
| 5,850,764 A | * | 12/1998 | Bostelmann et al. | 123/192.2 |
| 6,019,071 A | * | 2/2000 | Maciejka, Jr. | 123/41.35 |

FOREIGN PATENT DOCUMENTS

| | | |
|---|---|---|
| DE | 38 06 105 | 10/1988 |
| DE | 3805389 A1 * | 8/1989 |
| DE | 41 37 534 | 5/1992 |
| DE | 4204522 | 4/1993 |
| DE | 42 07 991 | 9/1993 |
| DE | 197 54 007 | 5/1999 |

* cited by examiner

*Primary Examiner*—Noah P. Kamen
(74) *Attorney, Agent, or Firm*—Michael Best & Friedrich LLP

(57) ABSTRACT

The invention relates to an internal-combustion engine, in particular for motorcycles, with a crankshaft (24) which is arranged in a crankcase (10, 14) and which is connected by way of connecting rods (20, 22) to pistons arranged so as to be movable in cylinders (16, 18), with an oil sump (12) which is situated below the crankcase (10) and from which the lubricating oil is conveyed to the consumer devices by way of an oil pump (60), and with means for returning the lubricating oil from the consumer devices to the oil sump (12). It is proposed that, in order to separate the oil taken up in particular by the crankshaft (24), a part of the crankcase (10) adjacent to the crankshaft (24) has a wall portion **(26*a* to *d*) which extends parallel to the axis of rotation of the crankshaft (24) and the outline of which is adapted to the enveloping curves of the crankshaft webs (27, 28) and/or the connecting rods (20, 22)**.

A rapid return of the lubricating oil to the oil sump is made possible by this step.

7 Claims, 7 Drawing Sheets

CRANK CASE HAVING AN OIL SEPARATION WALL

BACKGROUND OF THE INVENTION

The invention relates to an internal-combustion engine according to the features of the preamble of claim 1. Internal-combustion engines with a so-called wet-sump lubrication, in which the lubricating oil is returned from the cylinder-head housing and the crankcase to an oil sump situated below the crankcase are known prior art. In order that the lubricating oil should be returned to the oil sump as desired, it is known from the U.S. Pat. No. 5,452,692 for example to provide the crankcase in the region of the rotating crankshaft webs with so-called oil planes which wipe off the lubricating oil taken up by the rotation of the crankshaft, so that the oil can be conveyed to the oil sump by way of return openings as desired. For a continuous and reliable supply of lubricating oil it is necessary for the lubricating oil to be returned rapidly and de-foamed from the crank space to the oil-collecting chamber formed by the oil sump.

SUMMARY OF THE INVENTION

The object of the invention is therefore to improve the lubricating-oil circuit for a wet-sump lubrication of an internal-combustion engine so that the lubricating oil is returned rapidly from the consumer devices to the central oil-collection point situated below the crank-case.

This object is attained by the characterizing features of claim 1.

As a result of the wall portion of the crankcase which is designed as an oil plane and which is adapted to the outline of the enveloping curves of the crankshaft webs and/or the big ends of the connecting rods. the greater part of the oil taken up by these rotating, parts is separated and can thus be returned rapidly and on a direct path to the oil sump or the oil-collection point.

Further advantageous embodiments of the internal-combustion engine according to the invention are set out in the Sub-Claims.

Because of the oil-separating chamber which is situated behind the wall portion acting as an oil plane, the separated lubricating oil can be partially de-foamed even before it passes to the oil sump by way of the return openings provided in the oil-separating chamber and by way of an oil deflector. The return openings provided in the oil-separating chamber are used at the same time for the ventilation of the residual gases which are present in the oil sump and which can escape to the outside by way of ducts provided in the crankcase.

The oil-separating chamber situated behind the oil-plane wall portion is provided on the side with oil-return openings which lead to a lateral chamber of the crankcase. The rotor of a generator, which is fastened to the crankshaft flange and the rotation of which assists the return of the oil to the oil-collecting chamber, is arranged in this lateral chamber of the crankcase.

In a manner similar to the wall portion designed as an oil plane in the region of the crankshaft the part of the crankcase adjacent to a balancing shaft is likewise provided with a wall portion, the outline of which is adapted to the enveloping curve of the balancing shaft provided with a web.

DETAILED DESCRIPTION OF THE DRAWINGS

An embodiment of the invention is illustrated in the drawing and is explained in greater detail below. In the drawing FIG. 1 is a plan view of the lower part of the crankcase of an internal-combustion engine;

FIGS. 2*a* and 2*b* are sectional illustrations along the line II—II in FIG. 1;

DETAILED DESCRIPTION OF THE INVENTION

Figure 1:
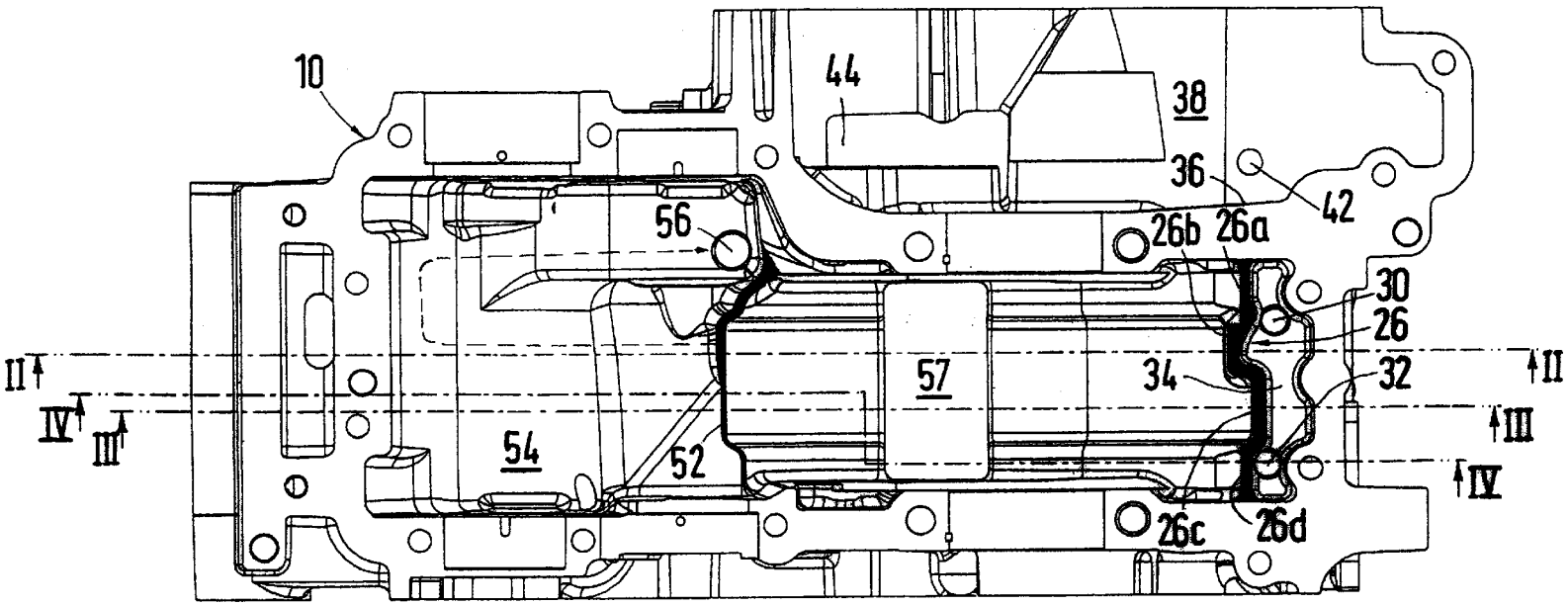
Figure 2A:
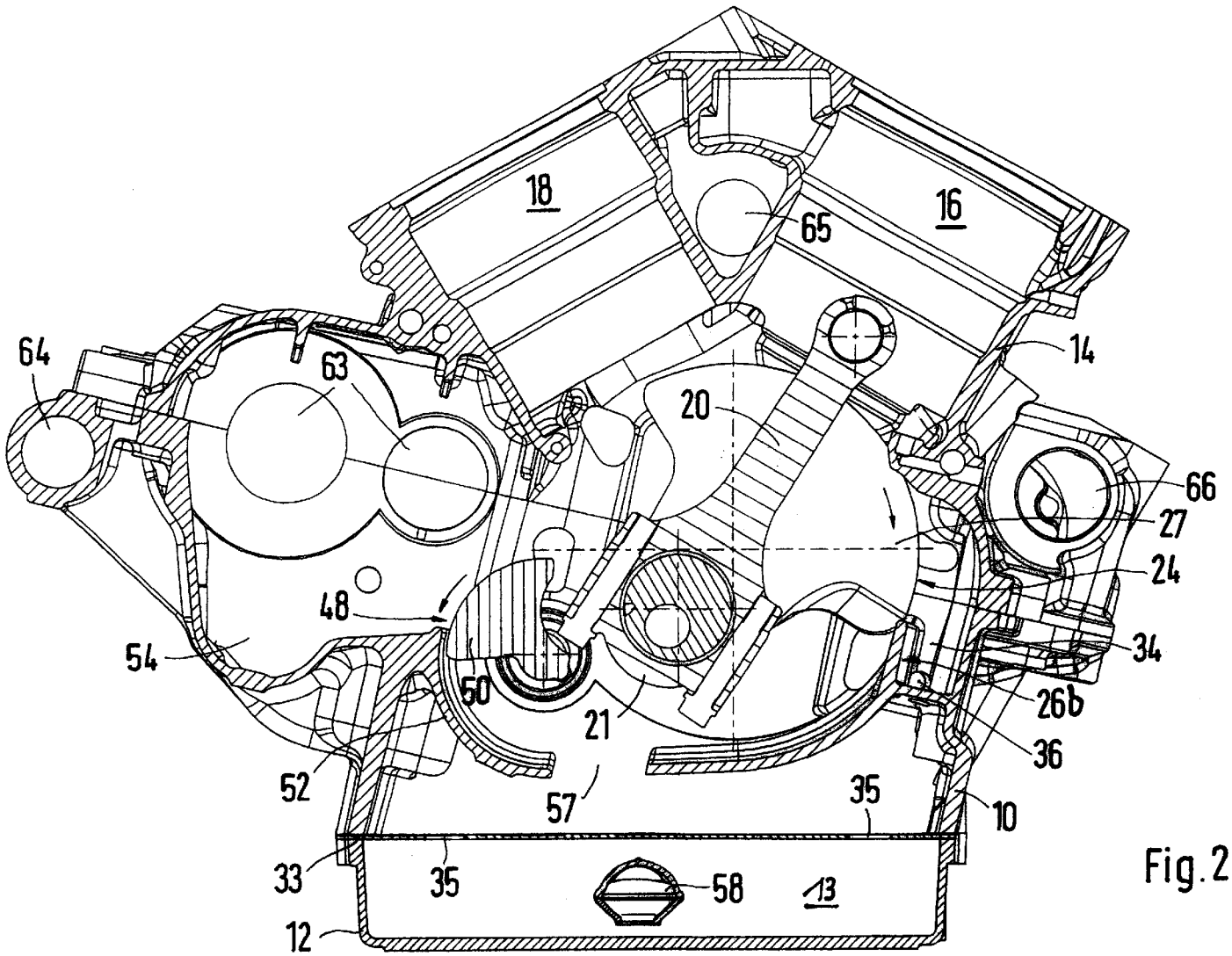
Figure 2B:
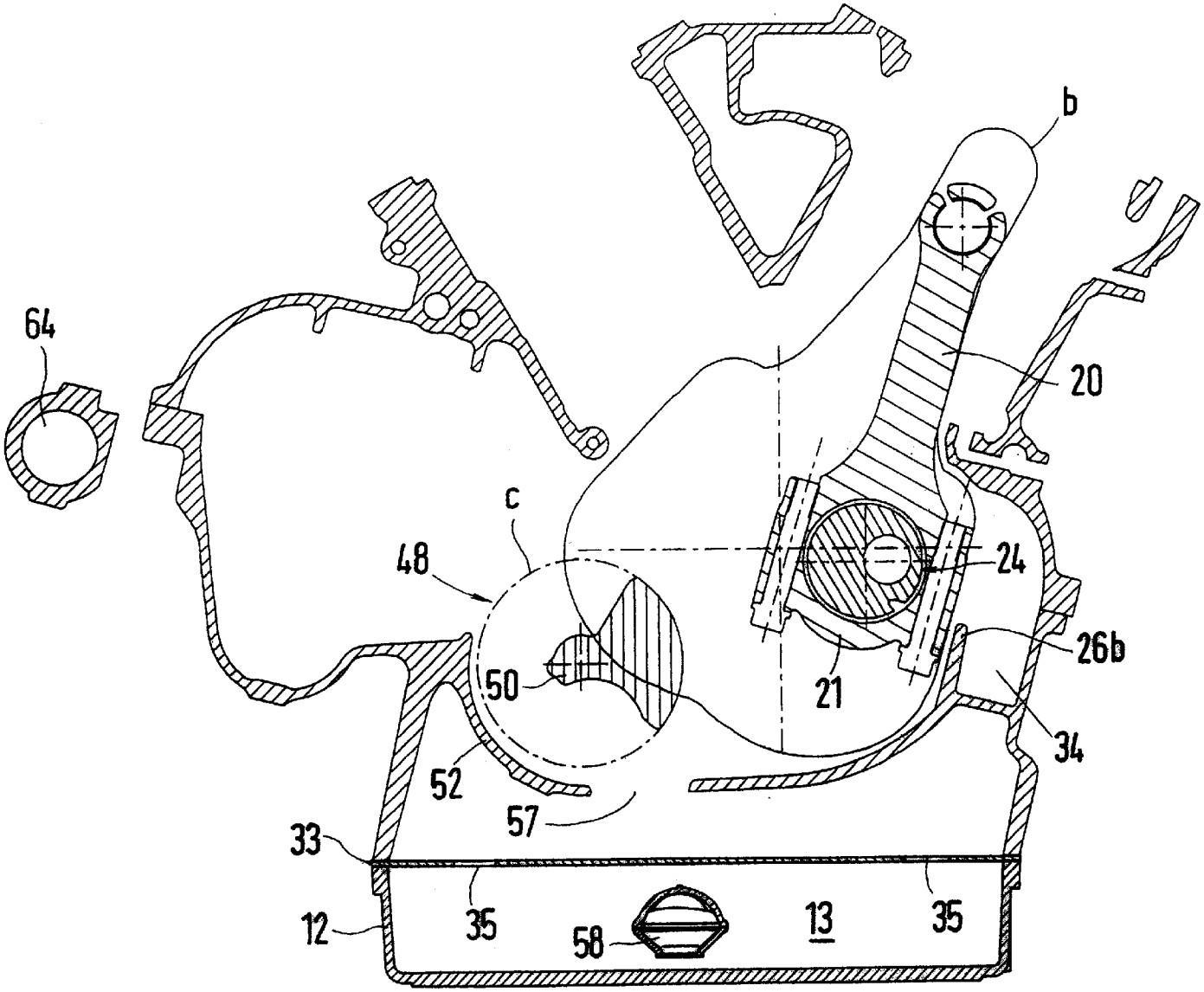
Figure 3:
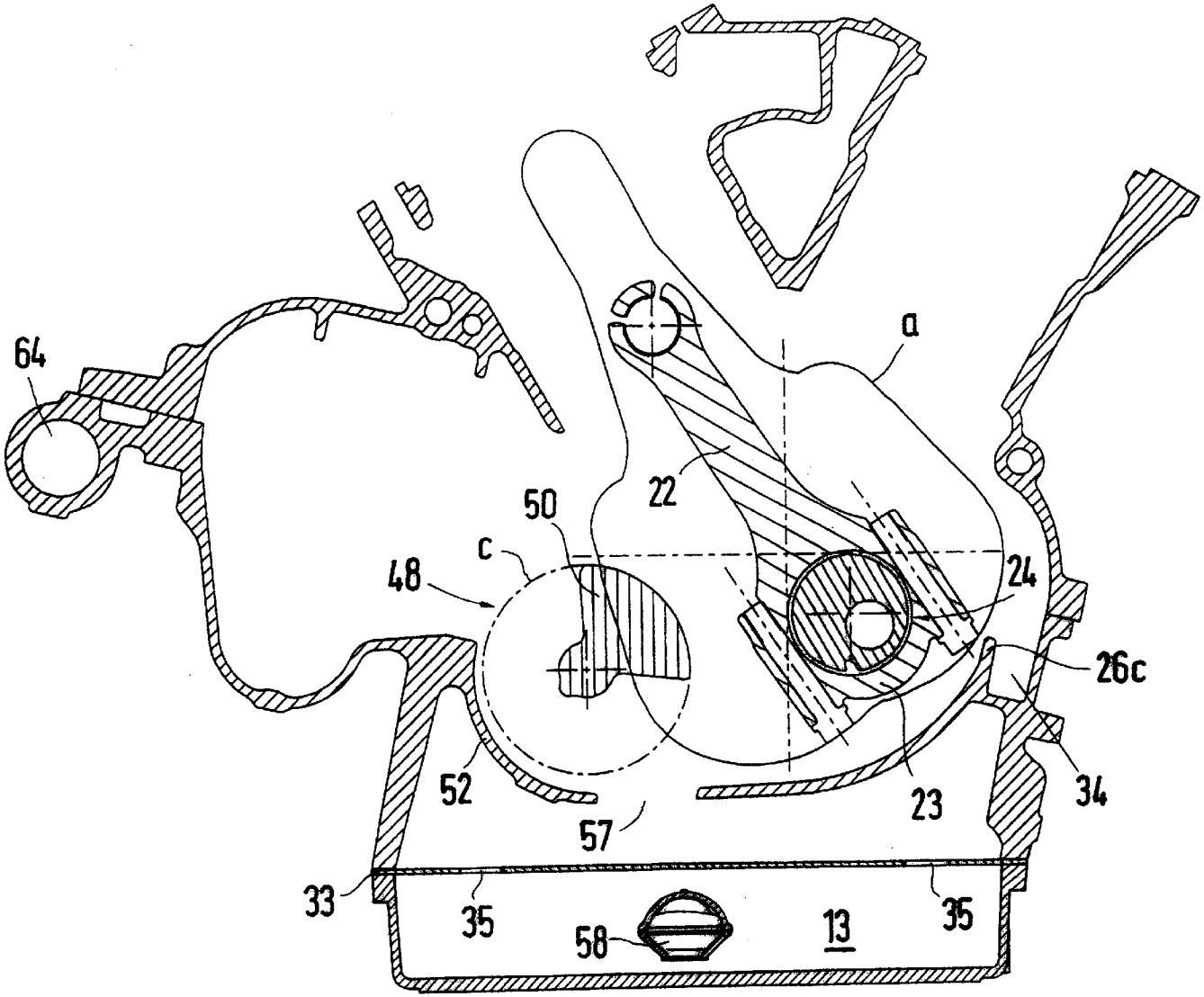
FIG. 3 is a section along the line III—III in FIG. 1.
Figure 4:
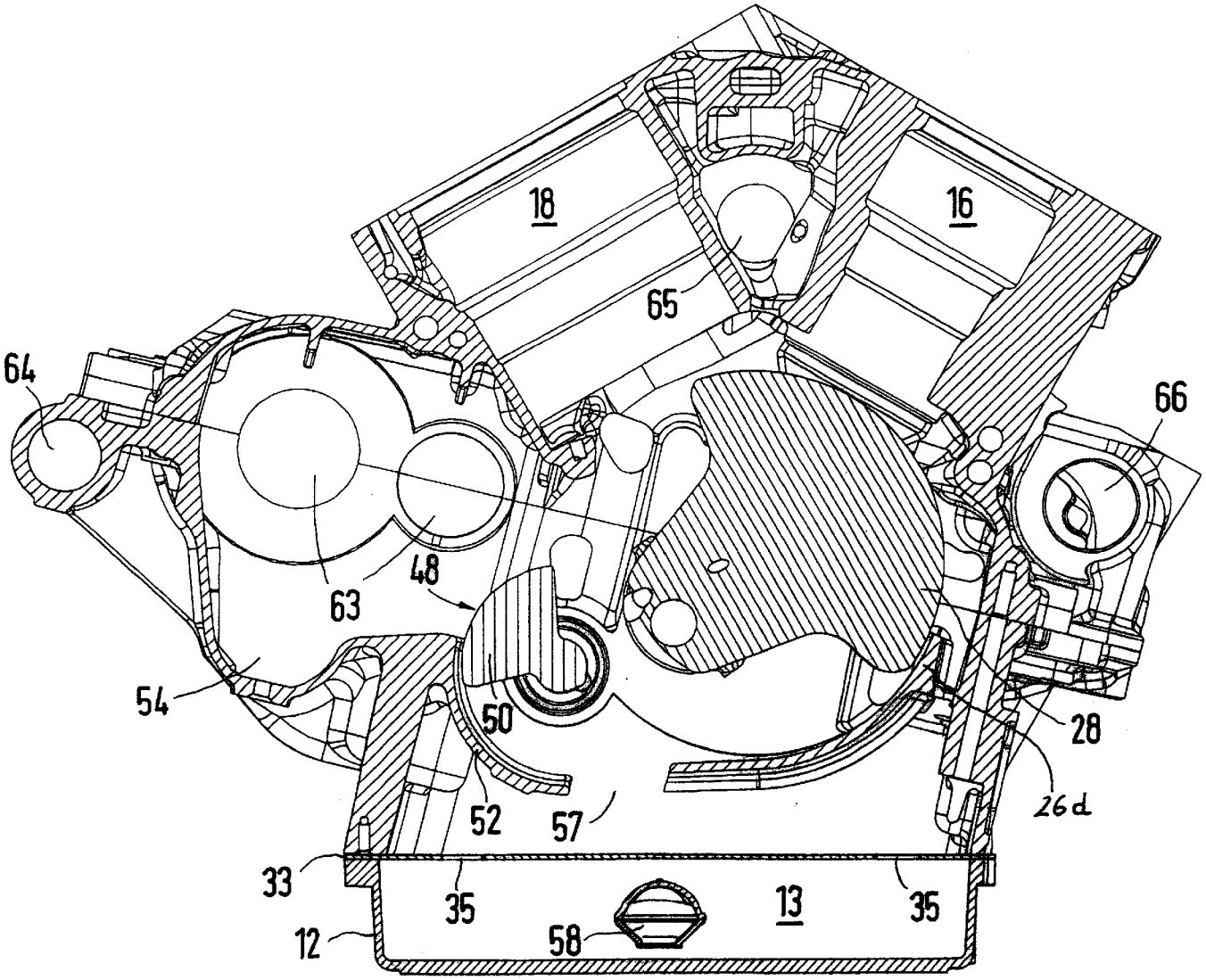
FIG. 4 is a section along the line IV—IV in FIG. 1.

The crankcase—constructed in two parts—of the internal-combustion engine has a lower crankcase half 10. at the lower end of which an oil sump 12 with an oil-collecting chamber 13 for collecting the lubricating oil is provided. Two cylinders 16 and 18 of the internal-combustion engine designed as a V-engine are incorporated in the upper crankcase half 14. The pistons (not shown in detail) situated in the cylinders 16, 18 are connected to a crankshaft 24 by way of connecting rods 20 and 22. A wall portion 26, which is arranged parallel to and at a distance from the rotational axis of the crankshaft 24, is provided in the lower crankcase half 10. In this case the outline of the wall portion 26 is adapted to the two enveloping curves a (see FIG. 3) and b (see FIG. 28) of the big ends 21, 23 of the two connecting rods and the enveloping curves of the two crankshaft webs 27, 28. The part 26*a* of the wall portion 26 illustrated in FIG. 1 is associated with the crankshaft web 27, the second part 26*b* is associated with the connecting rod 20 for cylinder 16. the third part 26*c* with the connecting rod 22 for cylinder 18 and the fourth part 26*d* is associated with the crankshaft web 28. This results in an oil plane which is adapted to the enveloping curves of the connecting rods 20, 22 or the big ends 21, 23 as well as the crankshaft webs 27, 28 and which separates the greater part of the lubricating oil entrained or taken up by these rotating parts.

An oil-separating chamber 34 provided with two return openings 30, 32 to the oil sump 12 is arranged behind the wall portion 26 as viewed in the direction of rotation of the crank-shaft 24; in this oil-separating chamber 34 the lubricating oil separated by the wall portion 26 is collected and returned to the oil sump 12 by way of the two return openings 30, 32. An oil deflector 33, which is provided with openings 35 for the return of the lubricating oil to the oil sump 12, is situated between the lower crankcase half 10 and the oil sump 12. Part of the lubricating oil can be de-gassed by the lubricating oil flowing along the oil deflector 33.

Figure 5:
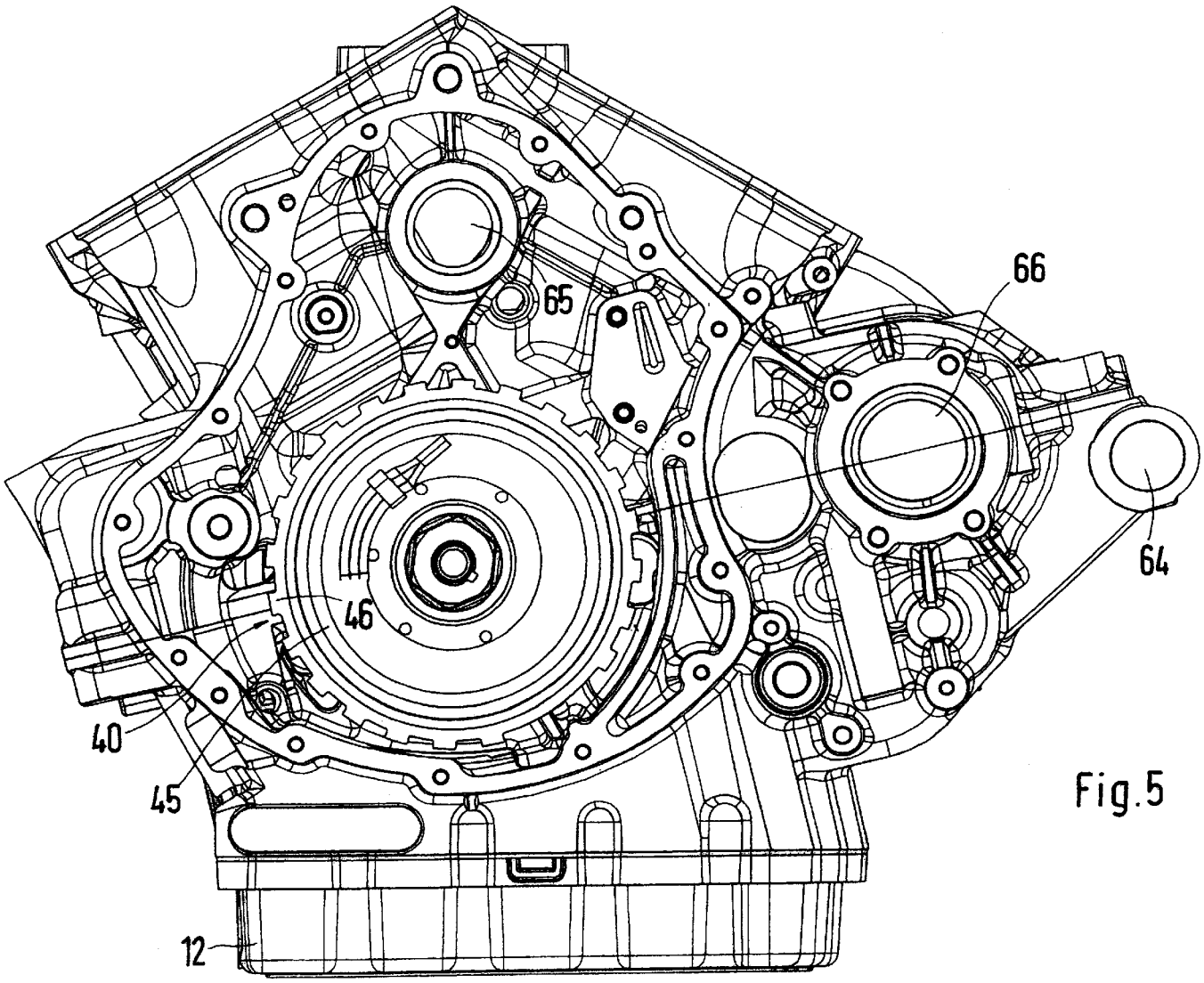
FIGS. 5 and 6 are two side views of the internal-combustion engine.

The two openings 30, 32 provided in the base region of the oil-separating chamber 34 are used at the same time for the ventilation of the residual gases which are present in the oil sump 12; the opening cross-section of the two oil-return openings 30, 32 is dimensioned in such a way that during the braking of the vehicle only a small quantity of oil from the oil sump 12 can reach the crank space. A further oil-return opening 36 arranged laterally in the oil-separating chamber 34 leads into a lateral chamber 38 in the crankcase, in which the generator 40 of the internal-combustion engine illustrated in FIG. 5 is situated. Further return openings leading to the oil sump 12 or the oil-collecting chamber 13 are provided in the lateral chamber 38, one opening being designed as a return bore 42 and the other as an oil-return window 44. Because of the base region of the oil-separating chamber 34 provided with an incline towards the lateral chamber 38, the oil arrives in the lateral chamber 38. The return of the part of the lubricating oil removed to the lateral chamber 38 back to the oil-collecting chamber 13 being accelerated by the rotation of the rotor 45 and the sensor ring 46 of the generator 40 which is provided with a toothed external contour. The sensor ring 46 is used to determine the rotational speed and the top dead centre of the internal-combustion engine.

The balancing shaft 48, which is provided for balancing mass forces in the crankcase and which is driven by the crankshaft 24 by way of a toothed gearing (not shown) in the opposite direction, has a balancing web 50. A wall portion 52 adapted to the enveloping curve c of the balancing web 50 likewise acts as an oil plane and wipes off the greater part of the lubricating oil taken up by the balancing web 50 into the gearing space 54 of the internal-combustion engine situated therebehind. As shown by the broken flow line in FIG. 1, because of a suitably designed gradient in the gearing space 54 the lubricating oil flows to a return opening 56, from where it passes on a direct path by way of the oil deflector 33 into the oil-collecting chamber 13 formed by the oil sump 12. The residual part of the lubricating oil which has not been separated by way of the wall portions 36 and 52 flows back to the oil-collecting chamber 13 through a window-like opening 57 situated in the lower crankcase half 10 by way of the oil deflector 33.

Figure 6:
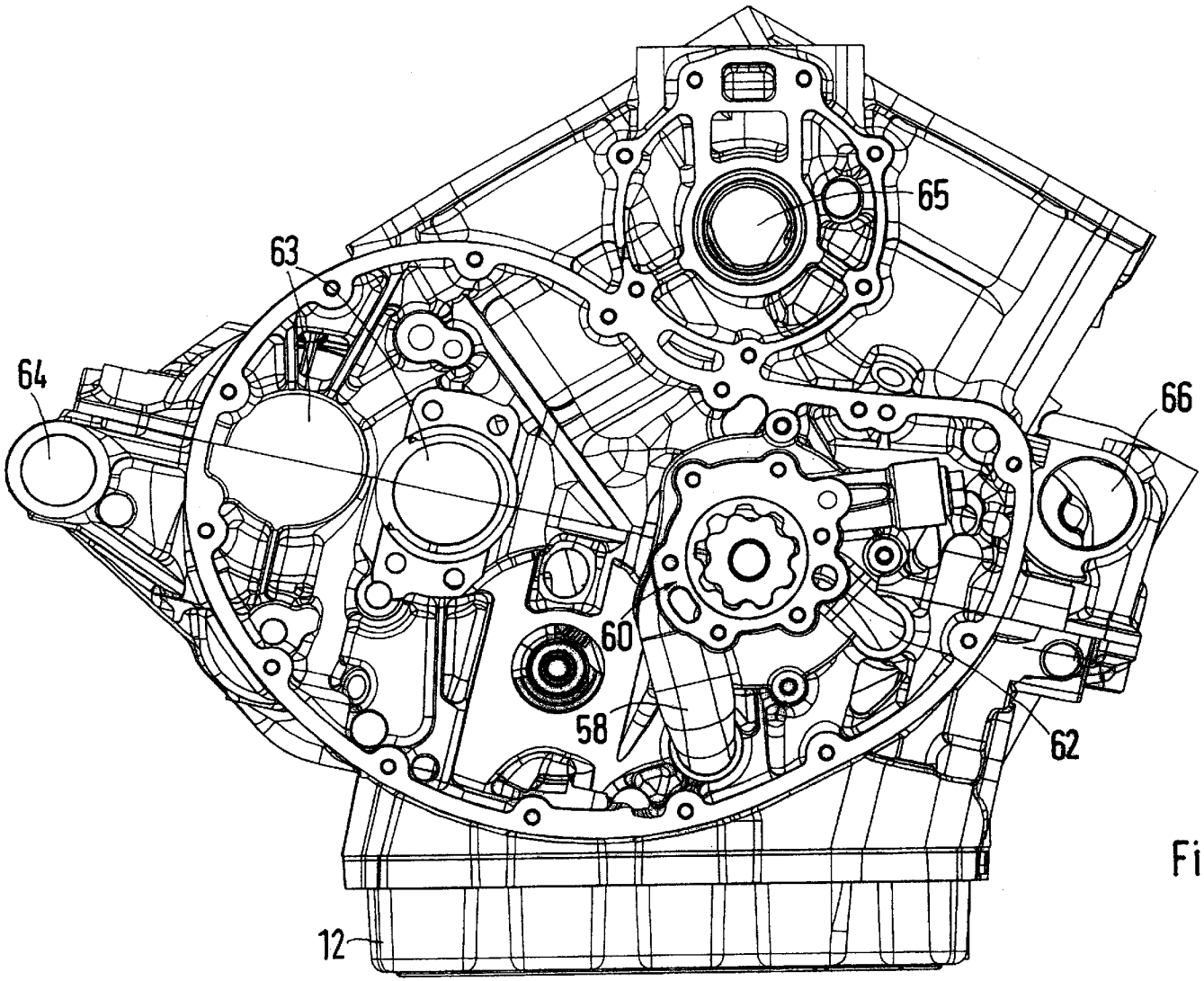

An oil snorkel 58 indicated only in outline in the oil sump 12 leads to an oil pump 60 which is illustrated in FIG. 6 and which draws the lubricating oil out of the oil-collecting chamber 13 by way of the oil snorkel 58 and conveys it back to the consumer devices by way of a pressure line 62.

The openings 63 formed in the gearing space 54 are used for receiving gearing shafts and the opening 64 is used for the engine suspension, whilst the opening 65 receives an intermediate shaft for the drive of a water pump and the camshafts; the opening 66 is used for receiving a starter for starting the internal-combustion engine.

What is claimed is:

1. An internal-combustion engine for motorcycles, the internal-combustion engine comprising a crankshaft arranged in a crankcase and connected by way of connecting rods to pistons arranged so as to be movable in cylinders, an oil sump which is situated below the crankcase and from which the lubricating oil is conveyed to the consumer devices by way of an oil pump, and means for returning the lubricating oil from the consumer devices to the oil sump, characterized in that, in order to separate the oil taken up in particular by the crankshaft (24), a part of the crankcase (10) adjacent to the crankshaft (24) has a wall portion (26*a* to *d*) which extends parallel to the axis of rotation of the crankshaft (24) and the outline of which is adapted to the enveloping curves of the crankshaft webs (27, 28) and the connecting rods (20, 22), the internal-combustion engine further comprising an oil-separating chamber (34) provided with return openings (30, 32, 36) to the oil sump (12) and arranged behind the wall portion (26) as viewed in the direction of rotation of the crankshaft (24), and wherein the oil separating chamber (34) is connected by way of an oil-return opening (36) to a lateral chamber (38) of the crankcase (10) in which a rotor (46) of a generator (40) secured to the crankshaft flange is situated, and further return openings (42, 44) in the lateral chamber (38) lead to the oil sump (12), wherein the return of the oil to the oil sump (12) is assisted by the rotation of the rotor (46).

2. An internal-combustion engine according to claim 1, characterized in that an oil-return opening (57) leading to the oil sump (12) is situated in a lower crankcase half (10).

3. An internal-combustion engine according to claim 1, characterized in that a balancing shaft (50) driven by the crankshaft (24) is arranged in the crankcase (10, 14), wherein the part of the crankcase (10) adjacent to the balancing shaft (50) has a wall portion (52) extending parallel to the axis of rotation of the balancing shaft (50) and the outline of which is adapted to the enveloping curve of the balancing shaft (50) provided with a web (50).

4. An internal-combustion engine for motorcycles, the internal-combustion engine comprising a crankshaft arranged in a crankcase and connected by way of connecting rods to pistons arranged so as to be movable in cylinders, an oil sump which is situated below the crankcase and from which the lubricating oil is conveyed to the consumer devices by way of an oil pump, and means for returning the lubricating oil from the consumer devices to the oil sump, characterized in that, in order to separate the oil taken up by the crankshaft (24), a part of the crankcase (10) adjacent to the crankshaft (24) has a wall portion (26*a* to *d*) which extends parallel to the axis of rotation of the crankshaft (24) and the outline of which is adapted to the enveloping curves of the crankshaft webs (27, 28) and the connecting rods (20, 22).

5. An internal-combustion engine for a motorcycle, the internal-combustion engine comprising:

a crankcase including a wall portion;

oil sump connected below the crankcase and adapted to contain oil;

an oil pump fluidly communicating with the oil sump and adapted to pump oil from the oil sump and to selected portions of the engine; and a crankshaft assembly including a crankshaft rotatably coupled to the crankcase, at least one connecting rod rotatably coupled to the crankshaft, and at least one crankshaft web coupled for rotation with the crankshaft;

wherein the outer surfaces of the connecting rod and crankshaft web define a non-linear crankshaft assembly profile; and the wall portion of the crankcase is shaped complimentary to the crankshaft assembly profile such that said crankcase wall portion is sufficiently proximate to substantially the entire crankshaft assembly profile to separate the greater part of the lubricating oil taken up by the connecting rod and the crankshaft web during operation of the engine.

6. The internal-combustion engine of claim 5, wherein the at least one connecting rod includes first and second connecting rods, and the at least one crankshaft web includes first and second crankshaft webs, and wherein the outer surfaces of the first and second connecting rods and the first and second crankshaft webs define the non-linear crankshaft assembly profile.

7. The internal-combustion engine of claim 6, wherein the first and second connecting rods are located between the first and second webs.

* * * * *